US008484909B2

(12) United States Patent
Thurner et al.

(10) Patent No.: US 8,484,909 B2
(45) Date of Patent: Jul. 16, 2013

(54) FOUNDATION SCREW WITH PORTIONS OF VARIABLE DIAMETER

(75) Inventors: Guenther Thurner, Straβkirchen (DE); Martin Thurner, Straβkirchen (DE)

(73) Assignee: Krinner Innovation GmbH, Strasskirchen (DE)

( * ) Notice: Subject to any disclaimer, the term of this patent is extended or adjusted under 35 U.S.C. 154(b) by 0 days.

(21) Appl. No.: 13/289,780

(22) Filed: Nov. 4, 2011

(65) Prior Publication Data

US 2012/0117893 A1 May 17, 2012

(30) Foreign Application Priority Data

Nov. 11, 2010 (DE) ..... 10 2010 043 785

(51) Int. Cl.
*E02D 5/74* (2006.01)

(52) U.S. Cl.
USPC ..... 52/157; 52/155; 405/252.1

(58) Field of Classification Search
USPC ..... 52/155, 157, 170; 405/252.1; 411/426
See application file for complete search history.

(56) References Cited

U.S. PATENT DOCUMENTS

| | | | | |
|---|---|---|---|---|
| 6,412,235 | B1 * | 7/2002 | Pylant | 52/155 |
| 6,494,643 | B1 * | 12/2002 | Thurner | 405/244 |
| 6,820,379 | B1 * | 11/2004 | Krinner et al. | 52/157 |
| 7,007,910 | B1 * | 3/2006 | Krinner et al. | 248/530 |
| 2001/0045067 | A1 * | 11/2001 | Cognon | 52/155 |

FOREIGN PATENT DOCUMENTS

| | | | |
|---|---|---|---|
| DE | 93 16 438 | U1 | 1/1994 |
| DE | 299 14 485 | U1 | 10/1999 |
| DE | 198 36 370 | A1 | 2/2000 |
| DE | 10 2007 027 545 | A1 | 12/2008 |
| DE | 10 2008 043 709 | A1 | 5/2010 |

OTHER PUBLICATIONS

Office Action dated Aug. 8, 2011, received in corresponding German Application 10 2010 043 785.9.

* cited by examiner

*Primary Examiner* — Jeanette E Chapman
*Assistant Examiner* — James Buckle, Jr.
(74) *Attorney, Agent, or Firm* — Miles & Stockbridge P.C.

(57) ABSTRACT

A foundation screw with a tubular basic body having an encompassing helical screw thread for screwing into the ground. The foundation screw has a substantially cylindrical first longitudinal portion and a tapering second longitudinal portion. The first longitudinal portion merges tangentially with a convex jacket region of the second longitudinal portion having a radius of convexity $R_1$, which has at least one value of the tube diameter D of the first longitudinal portion.

11 Claims, 3 Drawing Sheets

FOUNDATION SCREW WITH PORTIONS OF VARIABLE DIAMETER

FIELD OF THE INVENTION

The invention relates to a foundation screw with portions of variable diameter, comprising a tubular basic body having an encompassing helical screw thread, for screwing into the ground. Especially in the building field, foundation screws are used for anchoring such components as bars, posts, masts, or the like in the ground. As a rule, the foundation screws have a retaining portion in the upper region for receiving the anchoring component. This substantially cylindrically embodied portion is adjoined by at least one tapering portion, which as a result of the wedge or positive displacement effect hardens the surrounding soil as it is being screwed in.

BACKGROUND OF THE INVENTION

From German Patent DE 198 36 370 C2, it is known to produce the tapering portion of the foundation screw, which portion is embodied conically, by in-mold hammering. The conical portion can comprise a plurality of conical subportions which have a different conicity. In a first embodiment, the anchoring portion is embodied in one piece with the retaining portion, and alternatively, the two portions are embodied as separate components and are joined together for instance by suitable joining technology, resulting in a kink in the outer contour of the foundation screw in the transition region.

From German Patent Disclosure DE 10 2008 043709 A1, a method for producing a rotary foundation anchor is known, in which the tapering region of the rotary foundation anchor is formed by compression of the free end as a result of moving at least two molded bodies toward one another until they are together. In the production of the tapering region, which is a conical region, the result is a definite kink. Because of the production process, this kink has at best a radius in the range of the wall thickness of the tube that is used as a blank.

In such abrupt changes in the outer contour of foundation screws, it has proved disadvantageous that they present increased resistance to being screwed in as the foundation screw is being introduced into the ground. Moreover, the possibility exists that the soil in the vicinity of the cylindrical retaining portion will lift up, thus reducing the stability of the screwed-in foundation screw in the radial and axial directions.

From German Utility Model DE 93 16 438 U1, a foundation screw is moreover known which has a tubular basic body with an encompassing helical screw thread for being screwed into the ground. The basic body has a substantially cylindrical first longitudinal portion, a tapering second longitudinal portion, and a third longitudinal portion. The first longitudinal portion merges tangentially with the third longitudinal portion via one convex and one concave jacket region of the second longitudinal portion. The convex jacket region has at least one radius of convexity $R_1$ which has at least the value of the tube diameter D of the first longitudinal portion.

SUMMARY OF THE INVENTION

Thus it is the object of the present invention to furnish an outer contour for a foundation screw which can be screwed into the ground with the least possible expenditure of force, and in the screwed-in state, the foundation screw furnishes increased stability, in particular in the radial and axial directions.

This object is attained by a foundation screw having the features of claim 1. Further advantageous refinements of the invention will become apparent from the dependent claims.

The foundation screw of the invention has a tubular basic body having an encompassing helical screw thread for being screwed into the ground. The basic body has a substantially cylindrical first longitudinal portion, a tapering second longitudinal portion, and a third longitudinal portion. The first longitudinal portion merges tangentially with the third longitudinal portion, via one convex and one concave jacket region, respectively, of the second longitudinal portion. The radius of convexity of said convex of said jacket region has a value which corresponds to at least one time the diameter D of the first longitudinal portion.

The concave jacket region of the second longitudinal portion is preferably embodied with a radius of concavity $R_2$, which has the value which corresponds to at least one time the diameter D of the first longitudinal portion. The concave jacket region can be designed with a constant or variable radius of concavity $R_2$. Thus the radius of concavity $R_2$ can be designed as increasing in the longitudinal direction, or decreasing, or in any combination of different radii.

The third longitudinal portion is preferably embodied cylindrically. This yields a contour of the foundation screw in which the cylindrical first longitudinal portion is followed by a tapering second longitudinal portion with a convex and a concave jacket region and a cylindrical third longitudinal portion. However, the third longitudinal portion can also be designed for instance in tapering, in particular conical, fashion.

Also preferably, the third longitudinal portion is adjoined by a tapering fourth longitudinal portion, and the transition from the third to the fourth longitudinal portion is embodied as longitudinally tangential. Thus following the first three longitudinal portions, a further longitudinal portion can be mounted, which is embodied correspondingly to a second longitudinal portion, for example. Still further combinations of foundation screw portions according to the invention can preferably be embodied together with one another. The first longitudinal portion in the screwed-in state is as a rule disposed in the vicinity of the surface of the ground, but preferably ending flush with that surface, and the number of longitudinal portions increases with increasing depth. The highest-numbered longitudinal portion preferably merges with a tip of the foundation screw, the tip being introduced first as the foundation screw is being screwed into the ground.

The first longitudinal portion preferably receives the object to be secured, such as the post, and can therefore also be called a retaining portion. The object to be retained is preferably adapted to the internal contour of the retaining portion, which is embodied as a receptacle. Also preferably, the contours are adapted to one another in such a way that by means of a fit, they enable fixation of the object to be secured. The inner contour of the retaining portion is preferably embodied rotationally symmetrically, cylindrically or slightly conically, about a longitudinal axis of the basic body and thus of the foundation screw itself as well. However, the inner contour of the retaining portion can also be embodied in particular with further cross-sectional shapes, such as rectangular or polygonal shapes. Alternatively, the object to be secured can also be fixed for instance by introducing granulate or loose materials into the tubular basic body. In addition, still other securing means, familiar to the person skilled in the art, for securing the object to be secured to the foundation screw, such as clamping devices or screw means, can also be used.

The first longitudinal portion, in particular the outer contour of the first longitudinal portion, merges tangentially in the direction of the longitudinal axis with a convex jacket region. This convex jacket region forms at least one part of the second longitudinal portion. The convex jacket region has a radius of convexity $R_1$ which does not undershoot the value of the tube diameter D of the first longitudinal portion. Thus a continuous transition from the substantially cylindrical retaining portion to the second longitudinal portion is ensured. This continuous transition has the advantage that the foundation screw can be introduced into the ground with only a slight exertion of force, and that the soil which is compacted by the tapering part does not lift up from the outer contour at the transition zone to the cylindrical region, and thus no regions with voids or uncompacted soil develop. Such regions would reduce the stability of the object to be secured, such as a post.

Preferably, the convex jacket region has a constant radius of convexity. Alternatively, the radius of convexity $R_1$ is designed as variable over its length. Thus the radius of convexity $R_1$ can be designed as increasing or decreasing in the longitudinal direction, or any combination thereof . The radius of convexity $R_1$ furthermore preferably has a value which corresponds to at least five times the tube diameter $D_1$ of the first longitudinal portion.

The second longitudinal portion preferably has a conical jacket region. This conical jacket region for instance adjoins the convex jacket region in the longitudinal direction. Also preferably, this conical jacket region is adjoined by the concave jacket region of the second longitudinal portion. The conical jacket region can be designed with different cone angles, depending on the field in which the foundation screw is to be used.

The basic body of the foundation screw is preferably embodied in multiple parts. Thus it is possible in particular to embody individual longitudinal portions or combinations of a plurality of longitudinal portions as modules, which can be combined as desired. Thus by using a building block system, many different foundation screws for various kinds of applications are available. The individual modules can be joined by familiar joining and connecting techniques, such as welding, pressing, screwing, or similar methods.

For producing the foundation screws and the individual modules, various production processes can be employed, depending on the material of the modules. Convex, concave and conical regions of metal foundation screws can be produced, for instance by drawing, swaging, or casting. Plastic foundation screws, for instance, can be produced by injection molding.

The helical screw thread is preferably disposed in the longitudinal portions in an ordinal number greater than one; that is, it is disposed on all the longitudinal portions that are disposed between the first longitudinal portion and the tip of the foundation screw. Preferably, in an embodiment as a steel foundation screw, the helical screw thread is welded to the basic body. However, the helical screw thread can also be disposed only in some subregions thereof. The tip of the foundation screw is preferably embodied as a square tip. This kind of tip is especially advantageous in hammering in or screwing in the foundation screw, because it has great stability, forces small stones out of the way especially well, and is good at penetrating hard layers of soil.

BRIEF DESCRIPTION OF THE DRAWINGS

Further features and advantages of the invention will become apparent from the following exemplary embodiments in conjunction with the drawings. These show.

DETAILED DESCRIPTION

Figure 1:
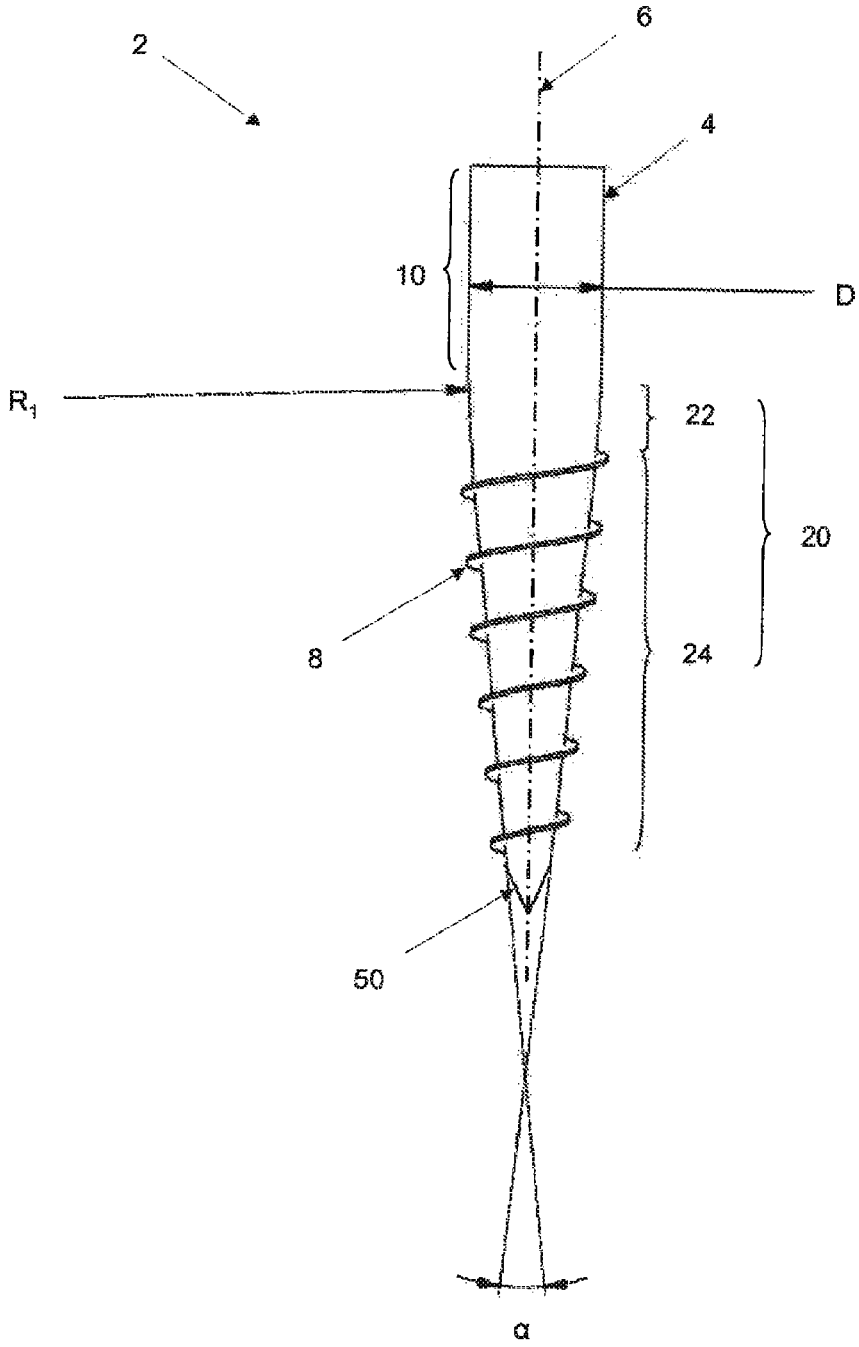
FIG. 1: a known form of a foundation screw.

In FIG. 1, a known form of a foundation screw 2 is shown. The foundation screw 2 comprises a tubular, hollow basic body 4 that has constant wall thicknesses. The basic body 4 extends substantially rotationally symmetrically about a longitudinal axis 6, which at the same time defines the longitudinal direction of the basic body 4. In a first longitudinal portion 10, the tubular basic body is embodied as a thin-walled hollow cylinder. In the first longitudinal portion 10, the basic body has both a constant outer tube diameter D and a constant inner tube diameter (not shown). Thus the first longitudinal portion 10 of the basic body 4 is suitable for receiving post-like structures which have an outer cross section corresponding to the inner diameter and which are to be anchored in the ground by the foundation screw 2.

From the first longitudinal portion 10, the tubular basic body 4 merges continuously with a second, tapering longitudinal portion 20. Both the outer and inner contours of the basic body merge in the longitudinal direction tangentially with a convex region of the second longitudinal portion 20. This region of the basic body 4 is also called the convex jacket region 22.

The convex jacket region 22 has a constant radius of convexity $R_1$, which is equivalent to three and a half times the value of the diameter D. The convex jacket region 22 merges in the longitudinal direction tangentially with a conical region 24 that has a cone angle of 12°. The conical jacket region 24 ends in a foundation screw tip 50. In the anchoring of the foundation screw 2, the foundation screw tip 50 is introduced into the ground first, and for increasing its stability it is embodied as a square tip.

The basic body 4 of the foundation screw 2 is surrounded in the second longitudinal portion 20 by a helical screw thread 8; the helical screw thread 8 extends from a rearward end of the foundation screw tip 50 over the entire conical jacket region 24. The basic body 4 and the helical screw thread 8 are of metal, and the helical screw thread 8 is joined to the basic body 4 via spot welds.

Figure 2:
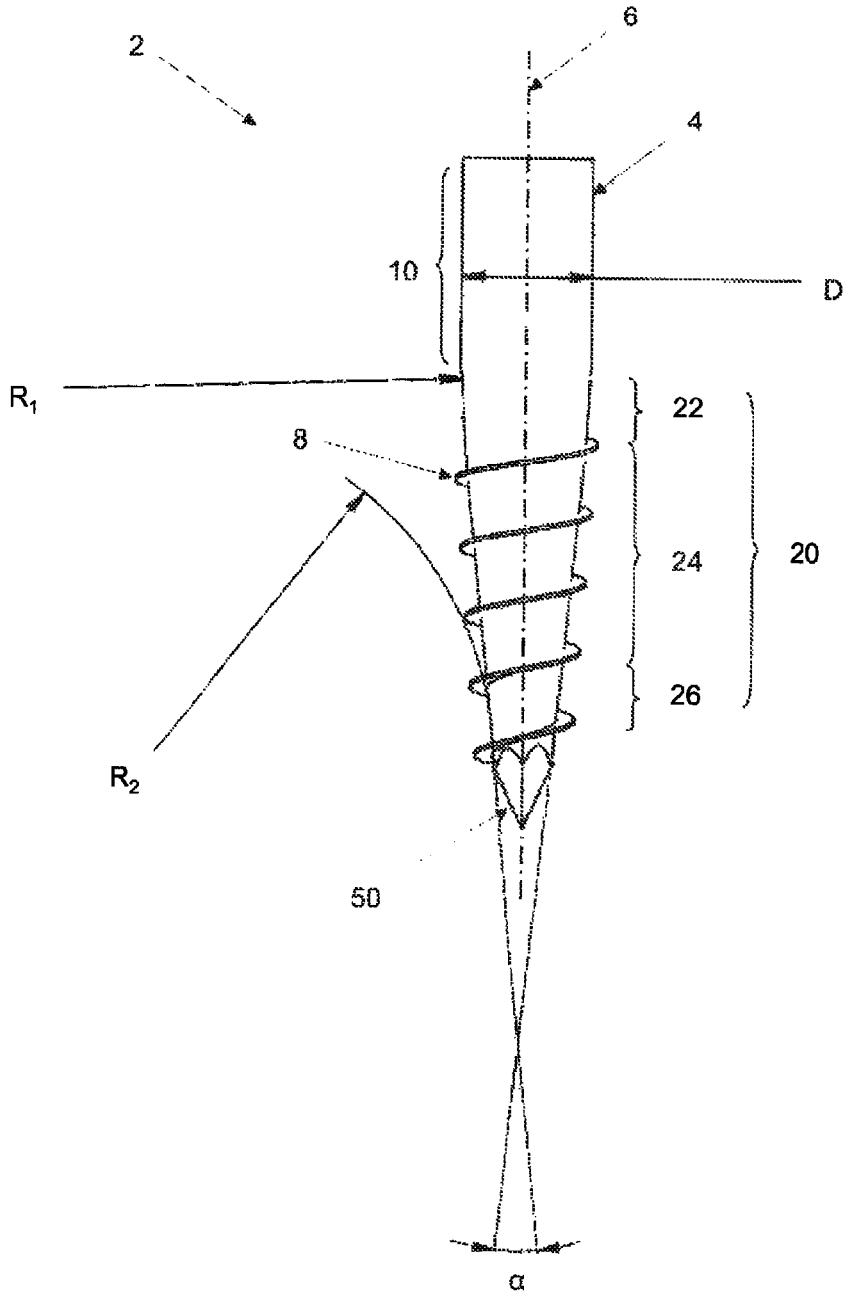
FIG. 2: a first embodiment of a foundation screw of the invention.

In FIG. 2, a first embodiment of a foundation screw of the invention is shown. In a departure from the form shown in FIG. 1, the second longitudinal portion 20 of the first embodiment additionally has a concave jacket region 26. The concave jacket region 26 has a constant radius of concavity $R_2$ having the value of 2.5 times D, and a radius of convexity $R_1$ in this exemplary embodiment has an also constant value of 13.5 times D. The conical jacket region 24 merges tangentially with a concave jacket region 26 of the second leg 20, and the concave jacket region 26 in turn merges with the foundation screw tip 50.

Figure 3:
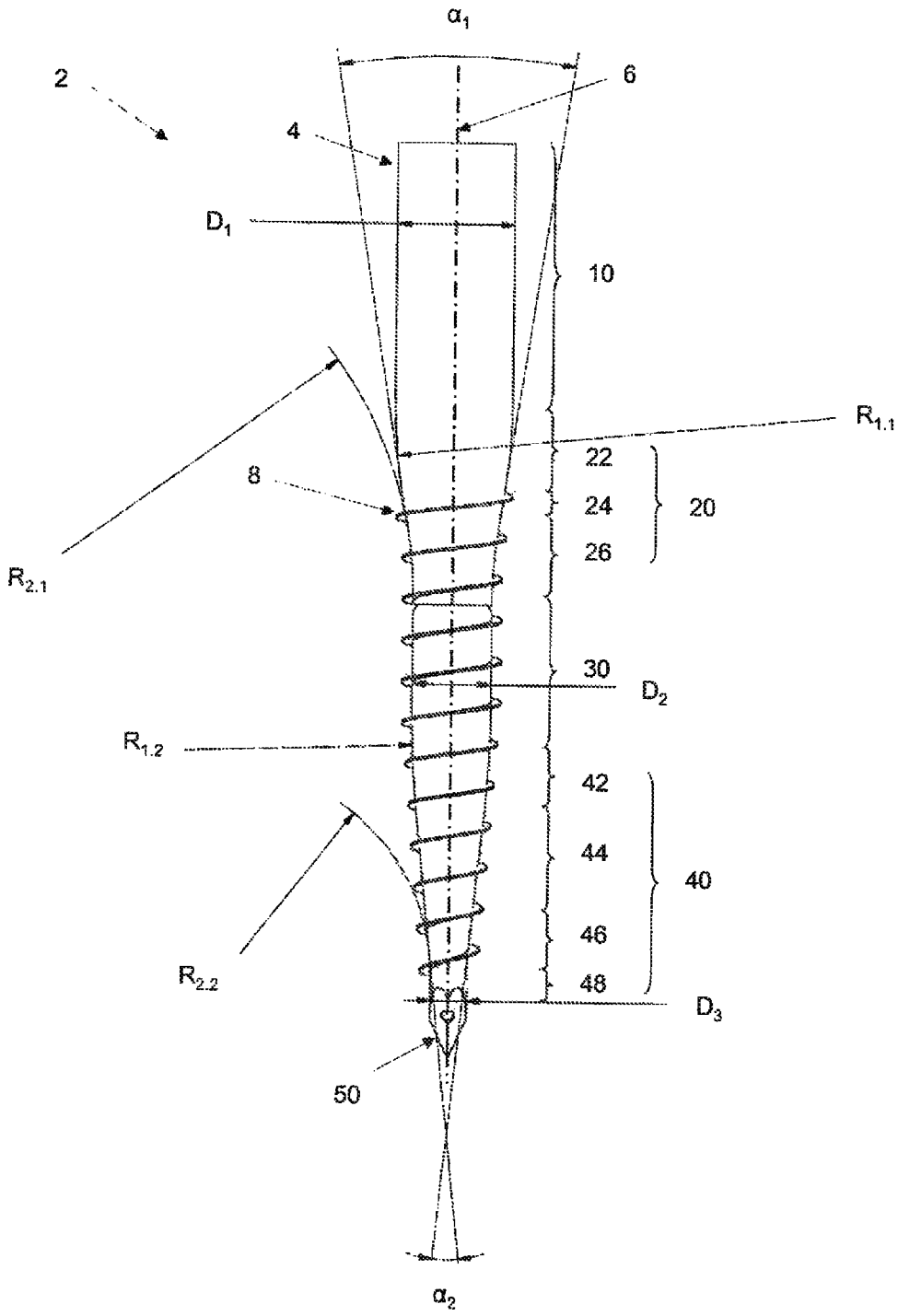
FIG. 3: a second embodiment of a foundation screw of the invention.

In FIG. 3, a second embodiment of a foundation screw of the invention is shown. In a departure from the embodiment of FIG. 1, the second longitudinal portion 20 does not merge directly with the foundation screw top 50; instead, a third and a fourth longitudinal portion 30, 40 are disposed between them. The third longitudinal portion 30 has a cylindrical contour and thus because of its tubular embodiment is designed in the form of a hollow cylinder. The concave jacket region 26 of the second longitudinal portion 20 merges tangentially with the third longitudinal portion 30. The fourth longitudinal portion 40 has one convex, one conical, one concave, and one cylindrical jacket region 42, 44, 46, 48, which each merge tangentially with one another. Thus the basic body 4 of the foundation screw 2 of FIG. 3 comprises a cylindrical first longitudinal portion 10; a tapering second longitudinal portion 20 with one convex, one conical, and one concave jacket region 22, 24, 26; a cylindrical third longitudinal portion 30; a fourth longitudinal portion 40 with convex, conical, and cylindrical jacket regions 42, 44, 46, 48; and the tip 50 of the foundation screw. The helical screw thread 8 extends over the second, third and fourth longitudinal portions 20, 30, 40 of the foundation screw 2.

The basic body 4 of the foundation screw 2 is moreover constructed in two parts, and the two parts are pressed together. At the transition between the second longitudinal portion 20 and the third longitudinal portion 30, a parting line can be seen on the outside. Because of this parting line, the transition from the second to the third longitudinal portion 20, 30, while not tangential in the strict mathematical sense, must nevertheless be seen as essentially tangential, taking the total course of the outer contour of the basic body 4 into consideration.

The radii $R_{1.1}$, $R_{1.2}$, $R_{2.1}$, $R_{2.2}$ of the convex and concave jacket regions 22, 26, 42, 46P, respectively, in such multiply-graduated basic bodies 4, are each referred to the next larger cylinder diameter; that is, the radii $R_{1.1}$ and $R_{2.1}$ are referred to the diameter $D_1$, and the radii $R_{1.2}$ and $R_{2.2}$ are referred to the diameter $D_2$. The radius of convexity $R_{1.1}$ thus has five times the value of $D_1$, and the radius of concavity $R_{2.1}$ has three and a half times the value of the cylinder diameter $D_1$. The radius of convexity $R_{1.2}$ has the value of 13.5 times $D_2$, and the radius of concavity $R_{2.2}$ has the value of 2.5 times $D_2$. The conical regions 24, 44 of the second and third longitudinal portion 20, 40 also have different cone angles, of $\alpha_1$=18° and $\alpha_2$=12°.

LIST OF REFERENCE NUMERALS

2 Foundation screw
4 Basic body
6 Axis
8 Helical screw thread
10 First longitudinal portion
20 Second longitudinal portion
22 Convex jacket region
24 Conical jacket region
26 Concave jacket region
30 Third longitudinal portion
40 Fourth longitudinal portion
42 Convex jacket region
44 Conical jacket region
46 Concave jacket region
48 Cylindrical jacket region
50 Tip of foundation screw
D, $D_1$, $D_2$ Tube diameter
$R_{1.1}$, $R_{1.2}$ Radius of convexity
$R_{2.1}$, $R_{2.2}$ Radius of concavity
$\alpha$, $\alpha_1$, $\alpha_2$ Cone angle

The invention claimed is:

1. A foundation screw comprising:

a tubular basic body having an encompassing helical screw thread for screwing into the ground and a substantially cylindrical first longitudinal portion, a tapering second longitudinal portion, and a third longitudinal portion, wherein the first longitudinal portion merges tangentially with the third longitudinal portion via one convex and one concave jacket region of the second longitudinal portion, wherein a radius of convexity of the convex jacket region has a value equal to at least the first longitudinal portion's tube diameter, wherein a radius of concavity of the concave jacket region has a value equal to at least the first longitudinal portion's tube diameter, and wherein the first and second longitudinal portions merge tangentially at the convex jacket region.

2. The foundation screw as defined by claim 1, wherein the third longitudinal portion is cylindrical.

3. The foundation screw as defined by claim 2, wherein the third longitudinal portion merges tangentially with a tapering fourth longitudinal portion.

4. The foundation screw as defined by claim 1, wherein the radius of convexity has at least one value of five times the tube diameter of the first longitudinal portion.

5. The foundation screw as defined by claim 1, wherein the convex jacket region has a constant radius of convexity.

6. The foundation screw as defined by claim 1, wherein the convex jacket region has a varying radius of convexity.

7. The foundation screw as defined by claim 1, wherein the second longitudinal portion has a conical jacket region.

8. The foundation screw as defined by claim 1, wherein the tubular basic body is embodied in multiple parts.

9. The foundation screw as defined by claim 1, wherein the radius of convexity of the convex jacket region has a value equal to at least 3.5 times the longitudinal portion's tube diameter.

10. The foundation screw as defined by claim 7, wherein said conical jacket region of said second longitudinal portion defines a cone angle of 18°.

11. A foundation screw comprising:

a tubular basic body having an encompassing helical screw thread for screwing into the ground and a substantially cylindrical first longitudinal portion, a tapering second longitudinal portion, and a third longitudinal portion, wherein the first longitudinal portion merges tangentially with the third longitudinal portion via one convex and one concave jacket region of the second longitudinal portion, wherein a radius of convexity of the convex jacket region has a value equal to at least the first longitudinal portion's tube diameter, and wherein the encompassing helical screw thread extends onto at least a portion of the second longitudinal portion.

* * * * *